US008284972B2

(12) United States Patent
Lin

(10) Patent No.: US 8,284,972 B2
(45) Date of Patent: Oct. 9, 2012

(54) SPEAKER ASSEMBLY

(76) Inventor: Chen-Che Lin, Keelung (TW)

( * ) Notice: Subject to any disclaimer, the term of this patent is extended or adjusted under 35 U.S.C. 154(b) by 603 days.

(21) Appl. No.: 12/421,622

(22) Filed: Apr. 9, 2009

(65) Prior Publication Data

US 2009/0257612 A1 Oct. 15, 2009

(30) Foreign Application Priority Data

Apr. 11, 2008 (TW) ..... 97206211 U

(51) Int. Cl.
*H04R 1/02* (2006.01)
*H04R 9/06* (2006.01)
*A47B 81/06* (2006.01)

(52) U.S. Cl. ..... 381/322; 381/334; 181/199

(58) Field of Classification Search ..... 181/176, 181/199; 381/345, 351, 334
See application file for complete search history.

(56) References Cited

U.S. PATENT DOCUMENTS 2,577,528 A * 12/1951 Kennedy ..... 312/7.1
2,589,319 A * 3/1952 Albrecht ..... 312/7.1
4,499,593 A * 2/1985 Antle ..... 381/378
5,082,084 A * 1/1992 Ye-Ming ..... 181/153
5,664,020 A * 9/1997 Goldfarb et al. ..... 381/89
5,892,182 A * 4/1999 Newman ..... 181/156
6,079,515 A * 6/2000 Newman ..... 181/156
6,104,819 A * 8/2000 Nickum ..... 381/123
6,466,681 B1 * 10/2002 Siska et al. ..... 381/372
7,116,795 B2 * 10/2006 Tuason et al. ..... 381/386
7,218,746 B2 * 5/2007 Schmidt et al. ..... 381/334
7,372,974 B2 * 5/2008 Yanagishita et al. ..... 381/384
7,814,583 B2 * 10/2010 Lerma ..... 4/541.1
2003/0205951 A1 * 11/2003 Lambert ..... 312/7.2
2004/0156517 A1 * 8/2004 Schmidt et al. ..... 381/334
2005/0058306 A1 * 3/2005 Peng ..... 381/118
2005/0091739 A1 * 5/2005 Lerma ..... 4/541.1
2005/0207603 A1 * 9/2005 Tse ..... 381/351
2006/0272885 A1 * 12/2006 Lee ..... 181/199
2007/0086613 A1 * 4/2007 Chang et al. ..... 381/333
2007/0086614 A1 * 4/2007 Ikeda et al. ..... 381/334
2008/0279406 A1 * 11/2008 D'Hoogh ..... 381/332

* cited by examiner

*Primary Examiner* — Elvin G Enad
*Assistant Examiner* — Alexander Talpalatskiy
(74) *Attorney, Agent, or Firm* — Muncy, Geissler, Olds & Lowe, PLLC

(57) ABSTRACT

A speaker assembly includes a speaker body and a resonating box. The speaker body formed by a main portion and a sound-emitting portion. The resonating box is provided within the speaker body. Both ends of the resonating box are connected to the main portion and the sound-emitting portion respectively. The resonating box is formed by connecting a plurality of resonating shells having decreasing widths. The resonating shells are made of rigid materials. Each of the resonating shells is slidingly connected with the adjacent resonating shells, so that the resonating shell is extendable between the main portion and the sound-emitting portion. Via this arrangement, in addition to amplify the music, the speaker assembly has a stress/bass effect to improve the quality of sound.

5 Claims, 6 Drawing Sheets

SPEAKER ASSEMBLY

BACKGROUND OF THE INVENTION

1. Field of the Invention

The present invention relates to a speaker assembly, and in particular, to a portable speaker assembly.

2. Description of Related Art

With the advancement of electronic technology, many kinds of portable multi-media players are proposed. In order for a user to carry the multi-media player more conveniently, the manufacture strives to make the dimension of the multi-media player as small as possible. As the size is reduced, the arrangement within the player must be designed more precisely. Of course, it takes more time to make a precise design. In order to deliver the products as soon as possible, many manufacturers only request the player to give off sound correctly, but the sound volume of the player may be limited. If the user does not utilize earphones for the player with limited volume, then the user has to use an external portable speaker, in order to hear the sound from the player clearly. However, a common portable speaker only function as an amplifier but it is not provided with a resonating box having a stress/bass effect. Thus, such a portable speaker cannot satisfy the users who require high sound quality.

Consequently, because of the above limitation resulting from the technical design of prior art, the inventor strives via real world experience and academic research to develop the present invention, which can effectively improve the limitations described above.

SUMMARY OF THE INVENTION

In view of the above problems, the objective of the present invention is to provide a speaker assembly. In addition to amplify the music, the speaker assembly of the present invention can generate a stress/bass effect to improve the quality of sound. Thus, the competitiveness of the present invention in the market is increased.

To achieve the above-mentioned objective, the present invention provides a speaker assembly, which includes a speaker body and a resonating box. The resonating box is provided within the speaker body. Both ends of the resonating box are connected to two opposite ends of the speaker body. The resonating box is formed by connecting a plurality of resonating shells having decreasing widths. The resonating shells are made of rigid materials. Each of the resonating shells is slidingly connected with the adjacent resonating shells.

The present invention has advantageous features as follows. The speaker assembly can amplify music or sound. In addition, since the resonating shells are made of rigid materials, sound waves resonate after passing through the resonating box, so that the generated music or sound can have a stress/bass effect to improve the quality of sound. Thus, the competitiveness of the present invention in the market is increased.

DETAILED DESCRIPTION OF THE PREFERRED EMBODIMENTS

Figure 1:
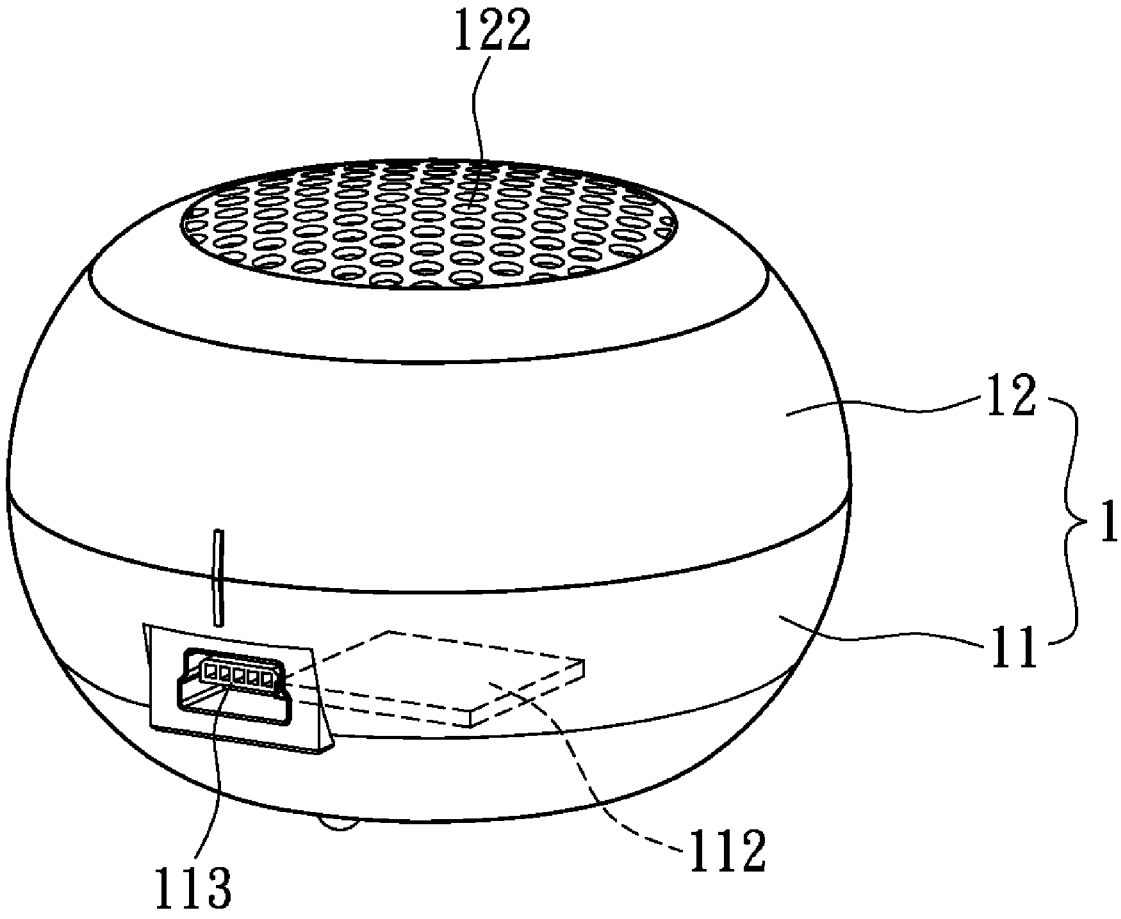
FIG. 1 is a perspective view showing a first state of a speaker assembly according to the present invention.
Figure 2:
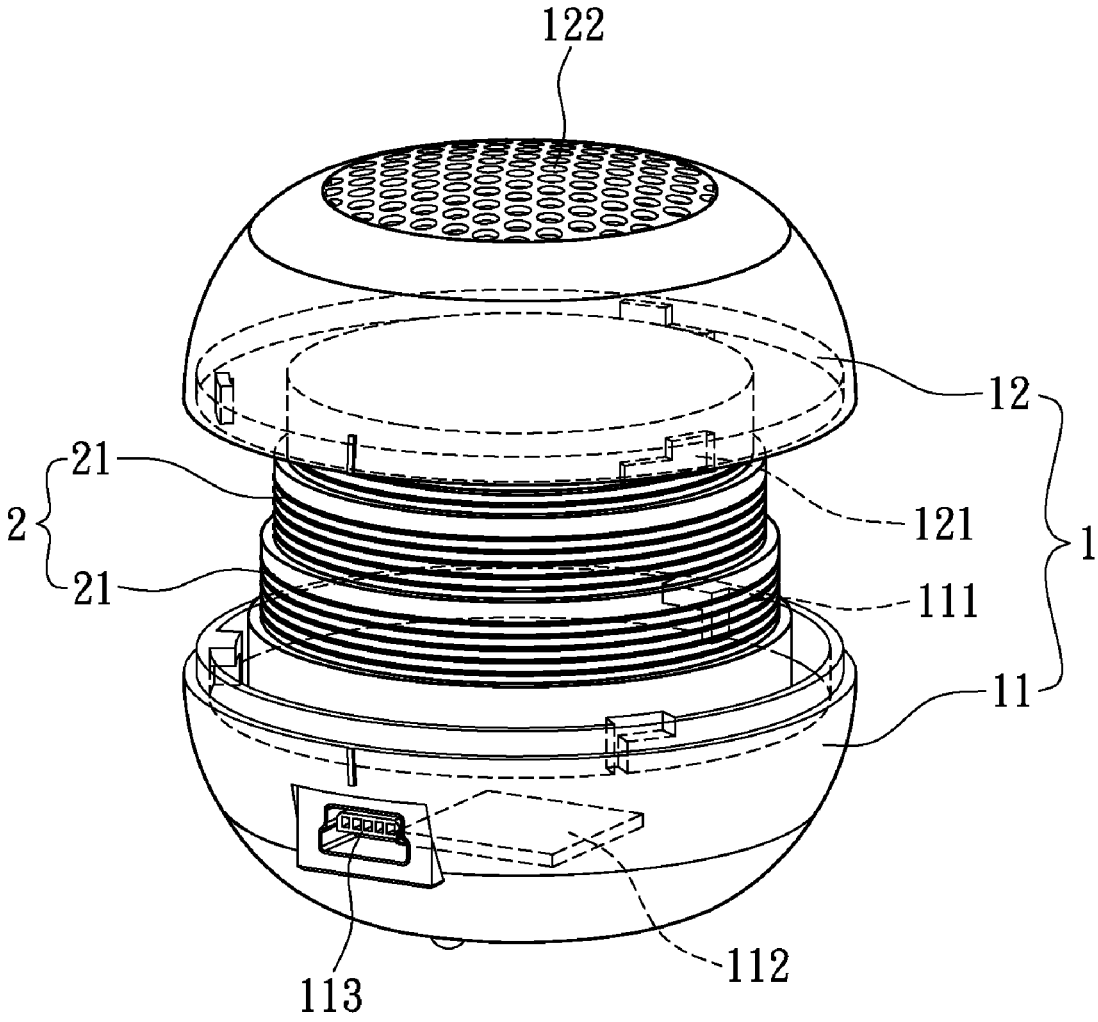
FIG. 2 is a perspective view showing a second state of the speaker assembly according to the present invention.

Please refer to FIGS. 1 and 2. The present invention provides a speaker assembly, which includes a speaker body 1 and a resonating box 2. The speaker body 1 comprises a main portion 11 and a sound-emitting portion 12. One end surface of the main portion 11 is provided with a plurality of first fixing portions 111 that are L-shaped and arranged at intervals. The end surface of the sound-emitting portion 12 opposite to the main portion 11 is provided with a plurality of second fixing portions 121 that are L-shaped and arranged at intervals. The first fixing portions 111 are engaged with the second fixing portions 121, so that the main portion 11 and the sound-emitting portion 12 are assembled to form the speaker body 1. Via this arrangement, the volume of the speaker assembly can be reduced, so that the user can carry it easily.

Figure 3:
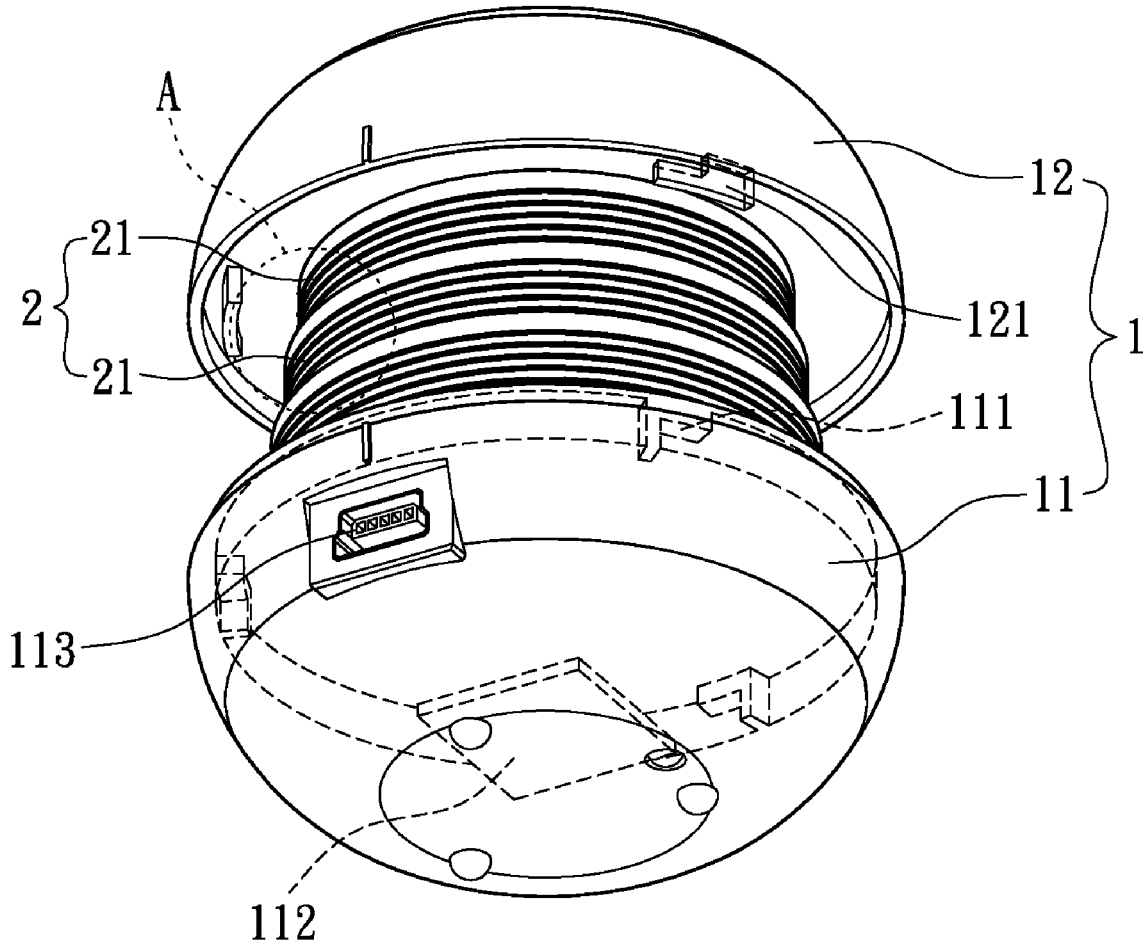
FIG. 3 is a perspective view showing a second state of the speaker assembly according to the present invention along another viewing angle.

Please refer to FIGS. 2 and 3. The resonating box 2 is provided within the speaker body 1. Both ends of the resonating box 2 are connected to the main portion, 11 and the sound-emitting portion 12 respectively. The resonating box 2 is formed by connecting a plurality of resonating shells 21 having decreasing widths. These resonating shells 21 can be made of rigid materials such as wood, metal, or hard plastic. The resonating shell 21 made of wood can exhibit the resonating effect optimally. Each of the resonating shells 21 is slidingly connected with the adjacent resonating shells 21, so that the resonating shells 21 are extendable between the main portion 11 and the sound-emitting portion 12. The resonating effect exhibited when each resonating shell 21 is extended is better than that exhibited when each resonating shell 21 is retracted.

Figure 4:
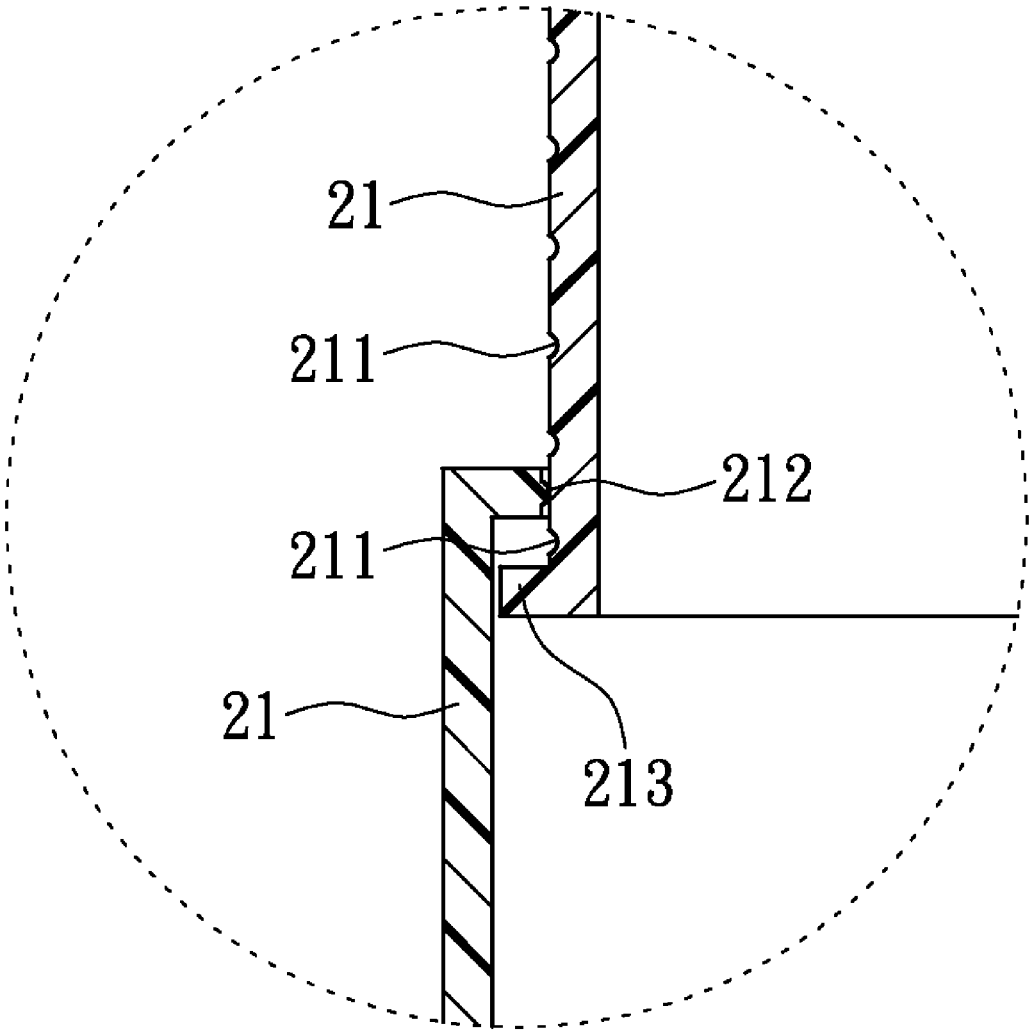
FIG. 4 is a partial perspective view showing the portion A in FIG. 3.

Please refer to FIGS. 3 and 4. The outer surface of each resonating shell 21 is provided with a plurality of positioning troughs 211, and the inner surface of each resonating shell 21 is provided with a plurality of positioning bosses 212. The outer surface of each resonating shell 21 extends outwards to form a protrusion 213. After each resonating shell 21 slides upwards a certain distance, the protrusion 213 of the resonating shell 21 may abut the inner wall of the adjacent resonating shell 21, thereby stops the sliding. The positioning bosses 212 of the resonating shell 21 are engaged with the positioning troughs 211 of the adjacent resonating shells 21, so that the resonating shells 21 can be fixed at different positions without any relative sliding. The interior of the main portion 11 is provided with an audio signal control circuit 112 for amplifying the audio signals and removing noises. The top of the sound-emitting portion 12 is provided with a speaker hole 122. The audio signals processed by the audio signal control circuit 112 pass through the resonating box 2. After being sent out from the speaker hole 122, the audio signals have a stress/bass effect.

Due to the fact that resonating shells 21 may have different shapes and designs, gaps may be generated between the resonating shells 21. In view of this, annular anti-leakage pieces (not shown) are provided between the resonating shells 21. The gaps between the adjacent resonating shells 21 are filled with the anti-leakage pieces, so that the sound can be prevented from leaking out of the gaps between the resonating shells 21, which would have reduced the resonating effect of the resonating box 2.

Figure 5:
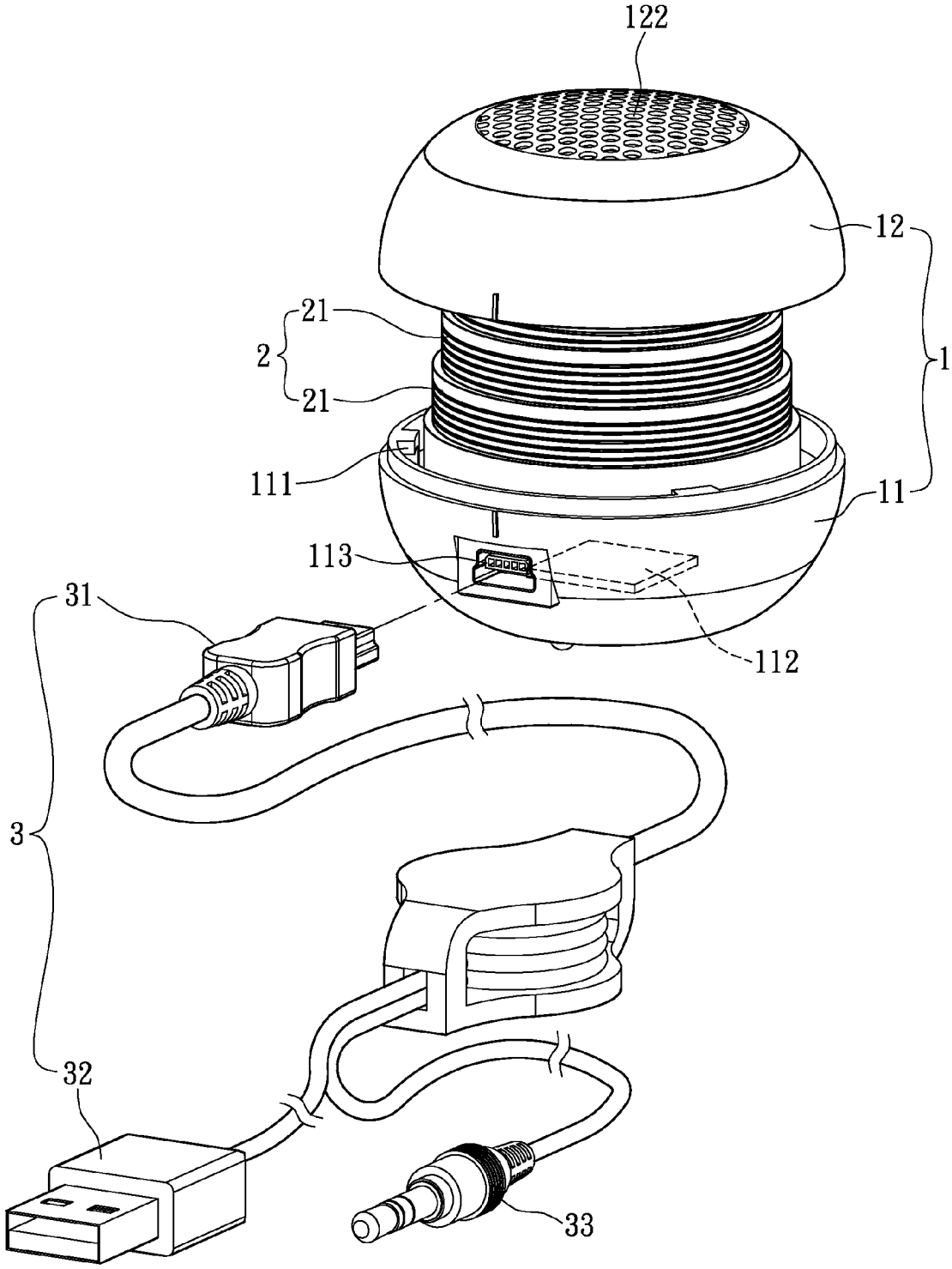
FIG. 5 is a perspective view showing the speaker assembly and a terminal adapter according to the present invention.

Please refer to FIG. 5. The speaker assembly further comprises a terminal adapter 3. The terminal adapter 3 has a first signal terminal 31, a second signal terminal 32, and a third signal terminal 33. The first signal terminal 31, the second signal terminal 32, and the third signal terminal 33 are signal terminals of different standards. The main portion 11 is provided with a first electrical connector 113. The first signal terminal 31 of the terminal adapter 3 is electrically connected to the first electrical connector 113. The second signal terminal 32 and the third signal terminal 33 of the terminal adapter 3 can be electrically connected to a portable multi-media player or a computer.

Figure 6:
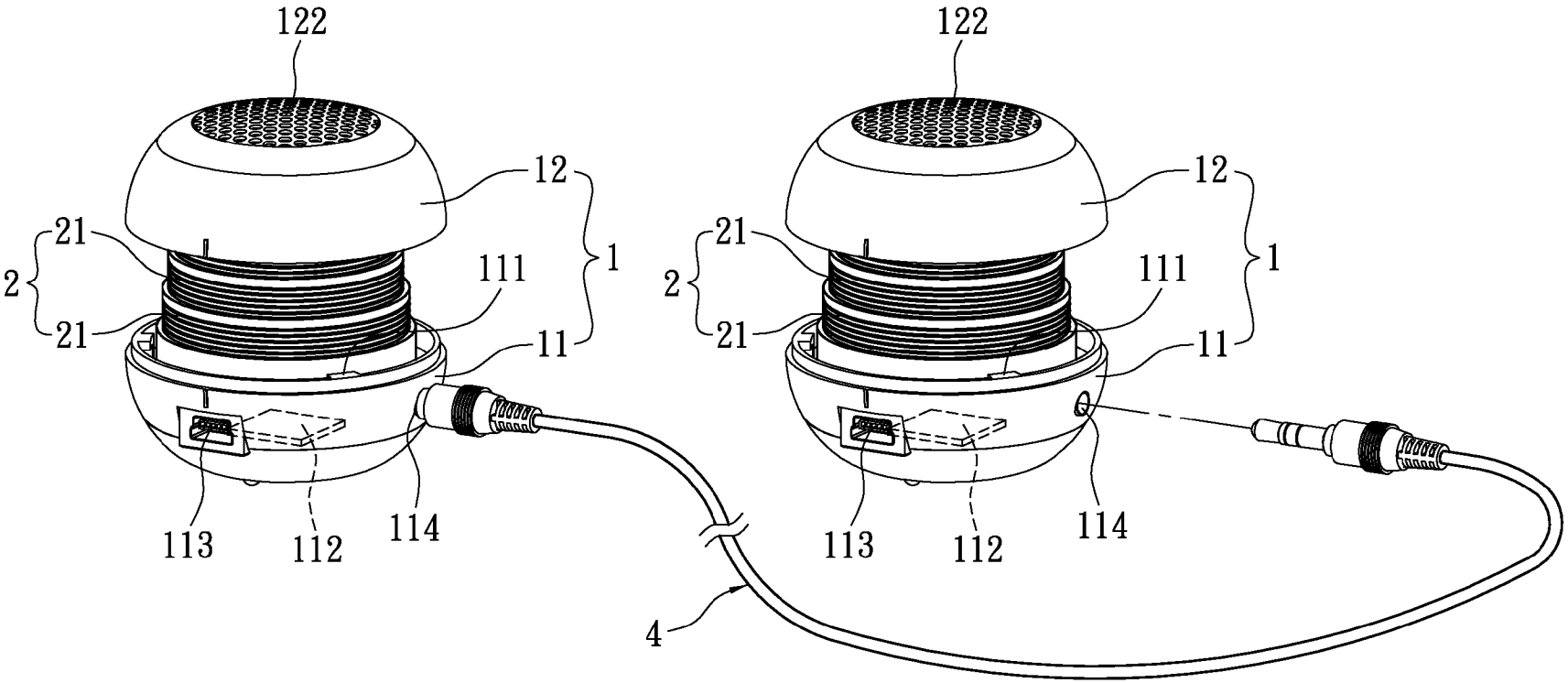
FIG. 6 is a perspective view showing the speaker assembly of the present invention being connected to another speaker assembly via a signal line.

Please refer to FIG. 6. The speaker assembly further comprises a signal line 4. The main portion 11 is further provided with a second electrical connector 114. According to the user's demands, both ends of the signal line 4 can be electrically connected to the second electrical connector 114 and another speaker assembly respectively. In this way, two speaker assemblies are connected to each other to generate a louder sound.

The speaker assembly of the present invention can amplify the music or sound. In addition, since the resonating box 2 is made of rigid materials, sound waves resonate after passing through the resonating box 2, so that the music or sound sent out via the speaker hole 122 can have a stress/bass effect to improve the quality of sound. Thus, the competitiveness of the present invention in the market is increased.

The above-mentioned descriptions represent merely the preferred embodiment of the present invention, without any intention to limit the scope of the present invention thereto. Various equivalent changes, alternations, or modifications based on the claims of present invention are all consequently viewed as being embraced by the scope of the present invention.

What is claimed is:

1. A speaker assembly, comprising:

a speaker body comprised of a main portion and a sound-emitting portion; and a resonating box provided within the speaker body, both ends of the resonating box being connected to two opposite ends of the speaker body and extendable between the main portion and the sound-emitting portion, one end surface of the main portion being provided with a plurality of first fixing portions at intervals, one end surface of the sound-emitting portion opposite to the main portion being provided with a plurality of second fixing portions at intervals, the first fixing portions are engaged with the second fixing portions to form the speaker body, the resonating box being formed by connecting a plurality of resonating shells with decreasing widths, each of the resonating shells being slidingly connected to the adjacent resonating shells, wherein the first fixing portions and the second fixing portions are L-shaped, and wherein an outer surface of each of the resonating shells is provided with at least one positioning trough, an inner surface of each of the resonating shells is provided with at least one positioning boss, the positioning boss of each resonating shell is engaged with the positioning trough of the adjacent resonating shell.

2. The speaker assembly according to claim 1, further comprising a terminal adapter, the terminal adapter having a plurality of signal terminals with different standards, the speaker body being provided with a first electrical connector, one of the signal terminals of the terminal adapter being electrically connected to the first electrical connector, other signal terminals of the terminal adapter being electrically connected to a portable multi-media player or a computer.

3. The speaker assembly according to claim 1, further comprising a signal line, the speaker body being provided with a second electrical connector, both ends of the signal line being electrically connected with the second electrical connector and another speaker assembly.

4. The speaker assembly according to claim 1, wherein the resonating shells are made of rigid materials.

5. The speaker assembly according to claim 1, wherein the resonating shells are annular.

* * * * *